US007918326B2

(12) United States Patent
Illedits et al.

(10) Patent No.: US 7,918,326 B2
(45) Date of Patent: Apr. 5, 2011

(54) DRIVING SYSTEM FOR PASSENGER TRANSPORTATION

(75) Inventors: Thomas Illedits, Neufeld (AT); Lukas Krauter, Vienna (AT)

(73) Assignee: Inventio AG, Hergiswil NW (CH)

( * ) Notice: Subject to any disclaimer, the term of this patent is extended or adjusted under 35 U.S.C. 154(b) by 823 days.

(21) Appl. No.: 11/772,892

(22) Filed: Jul. 3, 2007

(65) Prior Publication Data

US 2008/0017475 A1 Jan. 24, 2008

(30) Foreign Application Priority Data

Jul. 4, 2006 (EP) ..... 06116556

(51) Int. Cl.
*B56G 17/00* (2006.01)

(52) U.S. Cl. ..... 198/330

(58) Field of Classification Search ..... 198/326, 198/329, 330, 332
See application file for complete search history.

(56) References Cited

U.S. PATENT DOCUMENTS

| | | | | | |
|---|---|---|---|---|---|
| 2,060,491 | A | * | 11/1936 | Dunlop | 198/332 |
| 2,103,327 | A | * | 12/1937 | Handy | 198/332 |
| 2,128,310 | A | * | 8/1938 | Margles | 198/332 |
| 4,930,622 | A | | 6/1990 | Sansevero | |
| 5,697,486 | A | * | 12/1997 | Krampl | 198/332 |
| 6,016,902 | A | * | 1/2000 | Kwon | 198/332 |
| 6,832,678 | B2 | * | 12/2004 | Ogura et al. | 198/322 |
| 6,834,754 | B2 | * | 12/2004 | Pietz | 198/330 |
| 7,296,671 | B2 | * | 11/2007 | Pietz | 198/330 |
| 7,568,571 | B2 | * | 8/2009 | Ogimura et al. | 198/332 |
| 7,665,595 | B2 | * | 2/2010 | Matheisl et al. | 198/330 |

FOREIGN PATENT DOCUMENTS

| | | | |
|---|---|---|---|
| EP | 0711 725 | A | 5/1996 |
| WO | WO 00/07924 | A1 | 2/2000 |
| WO | WO 03/091145 | A1 | 11/2003 |

* cited by examiner

*Primary Examiner* — Douglas A Hess
(74) *Attorney, Agent, or Firm* — Ladas & Parry LLP

(57) ABSTRACT

A driving and/or reversing system includes a driving and/or reversing element and a chain having a plurality of first and second chain pins connected by chain plates. The driving and/or reversing element has first and second pitch circles. First and second chain pins are alternately correspondingly engaged with the first and second pitch circles.

13 Claims, 4 Drawing Sheets

Fig. 5A
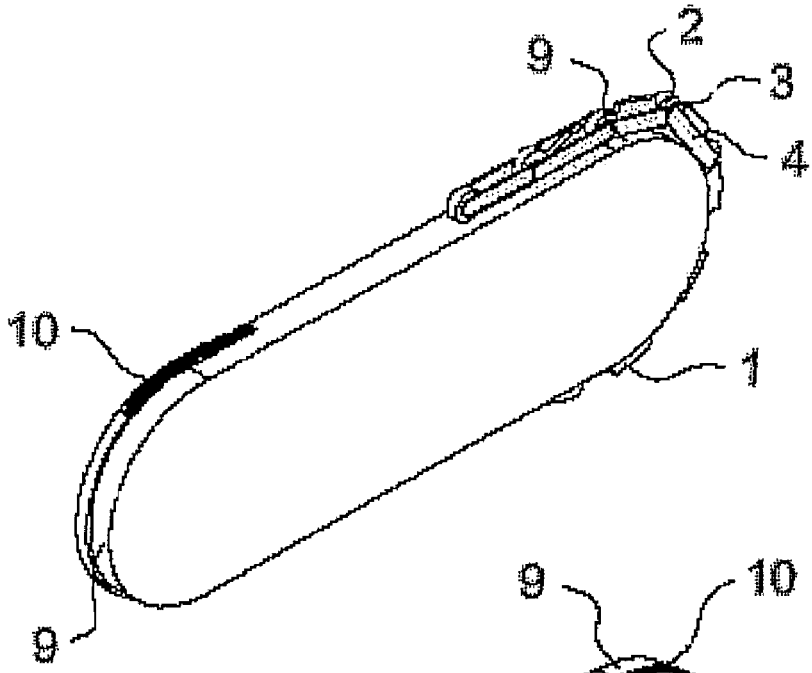
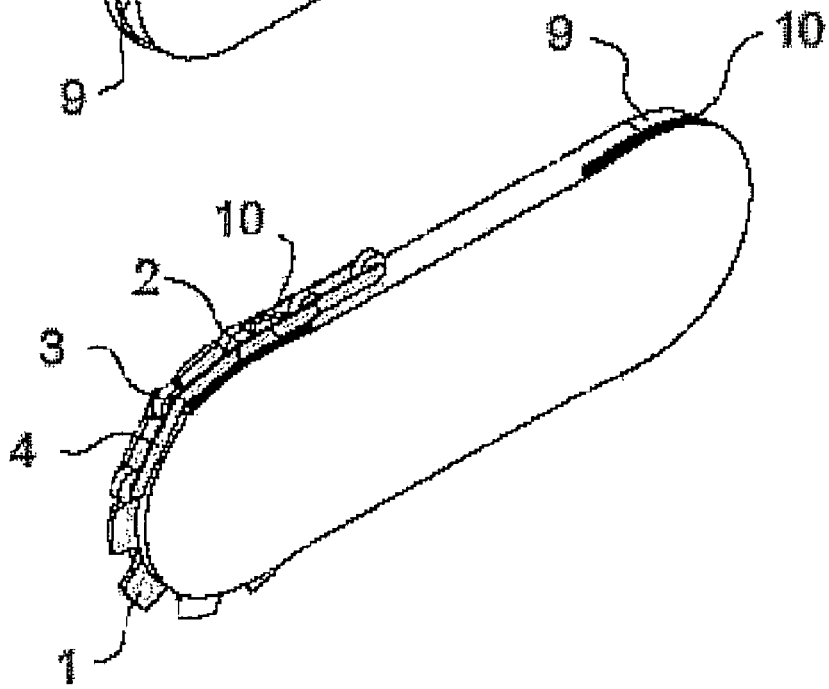
Fig. 5 B

DRIVING SYSTEM FOR PASSENGER TRANSPORTATION

The present invention relates to a driving and/or reversing element for a chain, in particular a driving and/or transporting chain of a continuous transporter for the transportation of persons or passengers and their hand baggage.

BACKGROUND OF THE INVENTION

Today, chains in countless variants are used in the construction of machines and systems as, for example, drive chains of continuous transporters for the transportation of persons, in particular of escalators, conveyors, and moving walks.

Driving elements drive the chain or step chain or pallet chain in the direction of circulation, while by means of rotation reversing elements transfer their individual translatory belt segments into each other. Preferably, but not necessarily, driving elements and reversing elements coincide and are executed in the form of, for example, chain wheels or wedge disks. Accordingly, now follows a short discussion of such engagement elements that engage with the chain or step chain by positive and/or non-positive engagement with the chain or step chain which they drive and/or reverse.

The engagement elements cause fluctuations in the speed of the chain strand in the longitudinal direction (i.e. in the direction of movement of the chain) and in the normal transverse direction thereto as a result of the so-called polygon effect. This results from the reversal of the individual chain links when running onto the chain wheel or engagement element. When this happens, the chain links experience a sudden acceleration perpendicular to the direction of circulation of the chain strand, because the individual chain links suffer a sudden rotational impulse—a running-in jerk or running-in thrust. Conversely, on running out, this rotational impulse causes the chain to roll in in the direction of rotation of the engagement element.

For a fuller understanding of the polygon effect, which as a result of induced vibrations is the main source of noise generation on maintained chains, causes them to wear, and, on people transporters, is experienced by the passengers as an unpleasant irregularity of motion, reference should be made to the relevant specialized literature, for example P. Fritz: Dynamik schnelllaufender Kettentriebe, VDI-Verlag, 1998, to which reference in its entirety is made.

With a conventional engagement element 100, illustrated diagrammatically in FIG. 1, a chain 200 runs into the pitch circle 500 tangentially in such manner that the chain pins 300 subsequently run on the pitch circle 500 with radius $R_{500}$. When, as shown in idealized form in FIG. 1, a pin in a vertical plane (shown dotted) enters for the first time into engagement with the element 100, from that point on the pin is forced to travel with a velocity $v=R_{500}\times\omega$, where $\omega$ is the constant speed of rotation of the engagement element. Its velocity $L=v\times\cos(\alpha)$ in the longitudinal direction of the loaded end (in the drawn plane of FIG. 1, horizontal) reduces as angle $\alpha$ increases. Correspondingly, the loaded end is moved with this reducing horizontal speed L until the next pin 300 enters into engagement with element 100 and is suddenly accelerated to v. This results in the periodically fluctuating end velocity $L=R_{500}\times\omega\times\cos(\alpha)$.

To avoid the polygon effect, WO 00/07924 proposes, as shown diagrammatically in FIG. 2, to gradually transfer the chain pins 310 from a smaller active circle (shown vertically dotted in FIG. 2), onto which the chain 210 runs tangentially, over a partially curved guide rail (not shown) onto the larger pitch circle 510 (shown dotted at angle $\alpha$ in FIG. 2). Simplified, should the radius r, on which the running-in chain pin 310 is guided, increase in the ratio $r(\alpha)=R_{500}/\cos(\alpha)$, a constant end velocity $L=R_{500}\times\omega$ can be generated, while the velocity of the chain pin w increases correspondingly to $w=R_{510}\times\omega$.

The engagement element is executed as a chain wheel 110 with constant pitch circle 510. It can be regarded as disadvantageous that the chain rollers in the area of the curved guiderails are lifted off the tooth bases of the chain wheel, i.e. they drift on the pitch circle relative to the engagement element, which causes generation of noise as well as premature wear. Shown by way of explanation in FIG. 2 is the engagement situation in which the chain pin 310 runs onto the tooth base at its lowest point. In this simplified illustration, the earlier start of engagement resulting from real contact geometry is ignored without the basic principles being affected. As can be seen by reference to the tooth spaces in the left part of the drawing, the chain pin 310 passes from the smaller active circle to the larger pitch circle 510 and thereby slides upwards within the tooth space relative to the teeth of the chain wheel 110.

BRIEF DESCRIPTION OF THE INVENTION

A purpose of the present invention is therefore to provide a driving and/or reversing element for a chain or step chain or pallet chain that has no polygon effect.

A further purpose of the invention is to provide a driving and/or reversing element that induces only a slight impulse and avoids the disadvantages of conventional driving/reversing elements.

According to the invention, the engagement element or chain wheel has a first pitch circle and a second pitch circle with different diameters such that first chain pins on the first pitch circle and second chain pins on the second pitch circle alternately enter into engagement, or are engaged, with the engagement element. "Alternately" relates to an arbitrarily predefined sequence of chain pins that can come alternately or mixed into engagement with the engagement element.

It is preferable for a chain pin to enter into engagement on one of the pitch circles and the following chain pin of the chain to enter into engagement on the other pitch circle (sequence 1-2-1-2 . . . ).

It is, however, also possible that not only a first, but also one or more directly following chain pins of the chain enter into engagement on the first pitch circle and only then one or more following chain pins engage on the second pitch circle. In the case of two successive chain pins on the first pitch circle and two following chain pins on the second pitch circle that follow after these, a following sequence results: 1-1-2-2-1-1-2-2 . . . . Similarly, in the case of three successive chain pins on the first pitch circle and three chain pins on the second pitch circle that follow after these, the following sequence results: 1-1-1-2-2-2-1-1-1-2-2-2 . . . . Self-evidently, irregular sequences are also possible where, for example, two successive chain pins on a first pitch circle are followed by only one single chain pin on the second pitch circle (sequence: 1-1-2-1-1-2 . . . ) or vice versa, where one single chain pin on a first pitch circle is followed by two chain pins on the second pitch circle (sequence: 1-2-2-1-2-2 . . . ). With knowledge of the present invention, arbitrary other sequences and combinations of first and second chain pins are possible that eliminate the polygon effect.

The similarity of this principle to the way in which the disclosure of WO 00/07924 works is shown greatly simplified in FIG. 3. Engagement of a chain pin 3A on the outer pitch circle 6 results in the same effect as in WO 00/07924, i.e. as a result of the smaller pitch circle radius, the following chain pin 3B is drawn in with constant loaded end speed L. However, on engagement of this chain pin 3B with the engagement element, contrary to WO 00/07924 it remains on the smaller pitch circle 5. Since the next chain pin 3C is again raised onto the larger pitch circle 6, the pin 3C experiences, in addition to its longitudinal velocity, a vertical component such that its total velocity, i.e. the velocity with which the loaded end is pulled in, increases. As a result of the reduction of the longitudinal component of the velocity of the chain pin 3B that is explained in relation to FIG. 1, the reduction of the loaded-end velocity can be compensated for. The chain pin 3C is accelerated to the velocity of rotation of the larger pitch circle 6 with which it then engages (as shown diagrammatically in FIG. 3).

Thus, while in WO 00/07924 each chain pin initially engages with the smaller active circle and then slides into the tooth space on the larger pitch circle, according to the present invention the chain pins engage alternately in different pitch circles. They therefore do not slide outwards or upwards relative to the engagement element or chain wheel but remain in the different pitch circles, which reduces wear and abrasion as well as the noise that occurs as a result of the relative movement between the chain pins and the engagement element.

In a preferred embodiment, during the entire reversal the chain pins rest on the tooth bases of the engagement element, embodied as a chain wheel. This results not only in a more stable guidance but also damps and reduces perpendicular and vertical oscillations of the chain.

Through reduction or elimination of the polygon effect, the noise and wear behavior of a chain drive with engagement elements according to the invention is greatly improved. Since the polygon effect is approximately proportional to the chain pitch (distance between the chain pins), as a result of the reduced or eliminated polygon effect larger pitches or smaller engagement element diameters or chain wheel diameters can be realized. The diameter of a chain wheels is proportional to the number of teeth, i.e. directly proportional to the pitch, so larger pitches mean fewer teeth and simpler or more simply manufacturable chain wheels. This results in advantages with respect to material outlay, fabrication, and series production.

It is preferable for the chain pins to incorporate chain rollers or steel rollers or plastic rollers or bushings that are borne rotatably in a manner that itself is known and through which they engage with the engagement element. When hereafter reference is made to chain pins, the reference includes these surrounding chain rollers or chain bushings which, as a result of the rolling instead of sliding friction, contribute to reducing friction and wear.

As already stated above in the explanation of the basic principle, in a preferred embodiment of the present invention the engagement element is executed as a chain wheel with toothing in which the chain pins engage in the tooth spaces of the chain wheel. This allows positive and reliable engagement between the chain pin and the engagement element. It is advantageous for the toothing to have alternately first tooth spaces on the first pitch circle and second tooth spaces on the second pitch circle. "Alternately" relates to an arbitrarily predefined sequence of tooth spaces that can be arranged alternately or mixed in an arbitrary sequence.

In an alternative embodiment, the engagement element can be executed equally well as a wedge wheel pair, the chain pins coming into positive contact with the wedge wheels. To form the different pitch circles, the wedge wheels can have alternating first areas with a first wedge angle and second areas with a second wedge angle different from the first wedge angle, the first pitch circle being defined by the contact points of the first chain pins with the first areas and the second pitch circle by the contact points of the second chain pins with the second areas. Although on the one hand wedge wheels require a minimum press-on force to create the necessary positive engagement, on the other hand they allow stepless setting of different reversal radii and driving ratios with the same driving units without additional gears or step gears.

According to the invention, at least two different pitch circles are provided onto which the chain pins alternately run. However, an engagement element according to the invention can have a third pitch circle such that first chain pins run on the first pitch circle, second chain pins run on the second pitch circle, and third chain pins run on the third pitch circle are alternately engaged with the engagement element. The third or also further pitch circles thereby can represent intermediate steps that allow a finer division of the chain while retaining the basic principle of the alternating pitch circles.

In a particularly preferred embodiment of the present invention, an engagement element embraces a first and/or a second guiderail that guides the first or second chain pin respectively on the first or second pitch circle. In particular, the guiderail that guides the chain pins on the larger pitch circle imparts to those chain pins an additional vertical velocity perpendicular to the longitudinal velocity and thereby compensates the reducing longitudinal component of the preceding chain pin. The chain pins can, however, be equally well guided only by the engagement element itself, for example the tooth spaces of a chain wheel on the corresponding pitch circle. In such a case, a small polygon effect may remain that depends on the geometry but which is, however, substantially reduced in comparison with conventional systems. Sliding of the chain pins relative to the engagement element can thereby be further prevented. Depending on the contact geometry, such relative sliding need not be completely avoided, but is reduced in principle through its occurrence on different pitch circles.

In a further development of the above particularly preferred embodiment, the first and second guiderails respectively guide the first and second chain pin respectively on the first and second pitch circle until they become disengaged from the engagement element. Rolling-in of the chain can thereby be avoided or at least reduced. In addition, sliding of the chain pins relative to the engagement element is thereby also reduced or entirely eliminated.

In an engagement element according to the invention, guidance of the chain pins on the pitch circle as described above is preferably realized in a manner that in itself is known in that the first and/or second chain pins respectively run on the first and second guiderails respectively. In a particularly advantageous further development of the present invention, a guide is provided in the plane of circulation of the chain strand that is divided into two halves, a first half forming the first guiderail and a second half opposite to it forming the second guiderail. On the first half of the facing side, the first chain pins have a larger diameter, particularly for a first chain roller, and therefore run on the first guiderail, while similarly the second chain pins on the opposite side have a smaller diameter, in particular for a second chain roller and therefore run on the second guiderail.

To avoid additional excitement in the perpendicular or vertical direction, an engagement element according to the invention is preferably embodied in such manner that the chain runs tangentially onto and off of the first and/or second pitch circle.

BRIEF DESCRIPTION OF THE DRAWINGS

Further purposes, characteristics, and advantages of the present invention will be apparent from consideration of the following detailed description of a preferred but nonetheless illustrative embodiment thereof, when reviewed in conjunction with the annexed drawings, wherein:

FIGS. 5A and 5B are simplified perspective views of a chain wheel of the general type of FIG. 4 with first and second guiderails, a part of a chain, and a further chain wheel according to the invention at a second end of the chain strand.

DETAILED DESCRIPTION OF THE INVENTION

The invention is explained in greater detail as follows by reference to a chain wheel. The invention can, however, be equally well realized by means of other engagement elements, in particular the already mentioned wedge-wheel pair, toroid pair, or similar gears or machine components.

Figure 4:
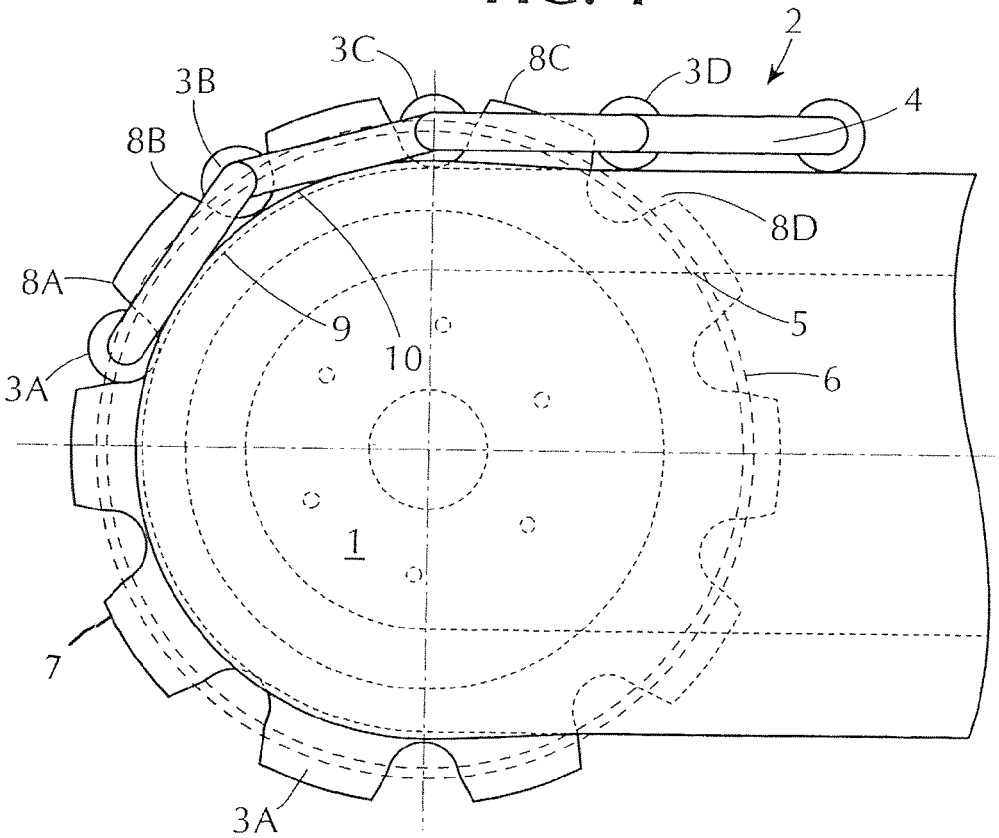
FIG. 4 is a diagrammatical side view of a chain wheel according to a further embodiment of the present invention.

FIG. 4 shows an engagement element according to the present invention in the form of a chain wheel 1 viewed from a side. The opposite side of the engagement element is shown in unfilled outline.

The chain wheel 1 reverses the chain 2 between an upper loaded portion and a lower unloaded portion through an angle of 180° and by means of a drive for the engagement element (not shown). The reversal angle and angle of wrap, as well as the entry and exit directions, are purely exemplary, other angles and directions can be equally well realized with engagement elements according to the invention.

The chain wheel has a first pitch circle 5 and a second pitch circle 6 with different diameters. In the exemplary embodiment, by way of example the second pitch circle diameter is the larger of the two. The chain wheel can, for example, be embodied as an involute gearing 7 with alternating tooth space depths, first tooth spaces 8A, 8C, etc., defining the first pitch circle 5 and second tooth spaces 8B, 8D, etc., defining the second pitch circle 6, which pitch circles are executed at different radial distances from the axis or middle of the chain wheel, but otherwise have similar or identical toothing geometry (as regards, for example, undercut, head-rounding, and the like).

The chain 2 includes chain pins that have mounted on them rotatable or slidable or swivelable chain rollers, runners or chain runners 3A, 3B, 3C, 3D, etc., that are joined to each other via chain plates or links 4. A first set of chain 3A, 3C, etc., are mounted to a first side of the corresponding chain pins, while a second set of chain rollers 3B, 3D, etc., alternates with the first set and are mounted to a second side of the corresponding chain pins.

By means of a first guide rail 9 arranged on the first side of the midline plane of the chain and the engagement element (in FIG. 4, below the plane of the drawing and therefore shown in outline), on which the first chain rollers 3A, 3C run, these first chain rollers and corresponding pins are guided tangentially to the first pitch circle 5 and from the vertical middle plane of the engagement element 1 are engaged with the latter. They thereby experience a constant circumferential velocity $v=R_5\times\omega$, where $R_5$ is the radius of the first pitch circle 5 and $\omega$ the rotational velocity of the chain wheel 1.

Arranged in similar manner on the opposite second side of the midline plane adjacent to the engagement element 1 is a second guiderail 10 on which the second chain roller 3B, 3D and corresponding pins run and to which the second pitch circle 6 is tangentially guided so that, from the vertical middle plane of the engagement element 1, the rollers are engaged with the latter. They thereby experience a constant circumferential velocity $w=R6\times\omega$, where R6 is the radius of the second pitch circle 6.

In a (not shown) further embodiment of the present invention, inside the chain plates 4 the chain pins may have continuous or divided chain rollers 3A, 3B, 3C, 3D, etc. The first chain rollers 3A, 3C project to the first side, the second chain rollers 3B, 3D to the second side. They run on the first and second guiderails 9 and 10 respectively.

In the exemplary embodiment shown, the alternating first and second tooth spaces 8A, 8C and 8B, 8D respectively are successively fitted with first and second chain rollers 3A, 3B, 3C, 3D respectively. By means of the guide rails 9, 10, these come tangentially into engagement with the respective pitch circle 5 or 6 without consequently sliding or moving within the tooth spaces. Advantageously, they rest consecutively on the tooth base and thereby reduce vertical or perpendicular vibrations upwards or downwards relative to the direction of travel of the chain strand 2.

Figure 1:
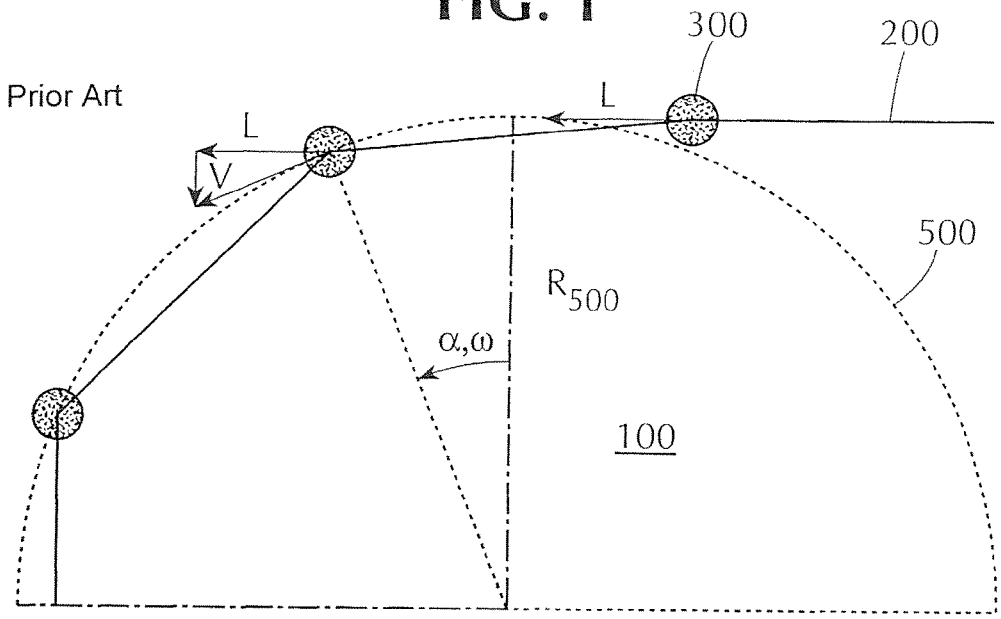
FIG. 1 is a diagrammatic representation explaining the polygon effect in a conventional engagement element.
Figure 2:
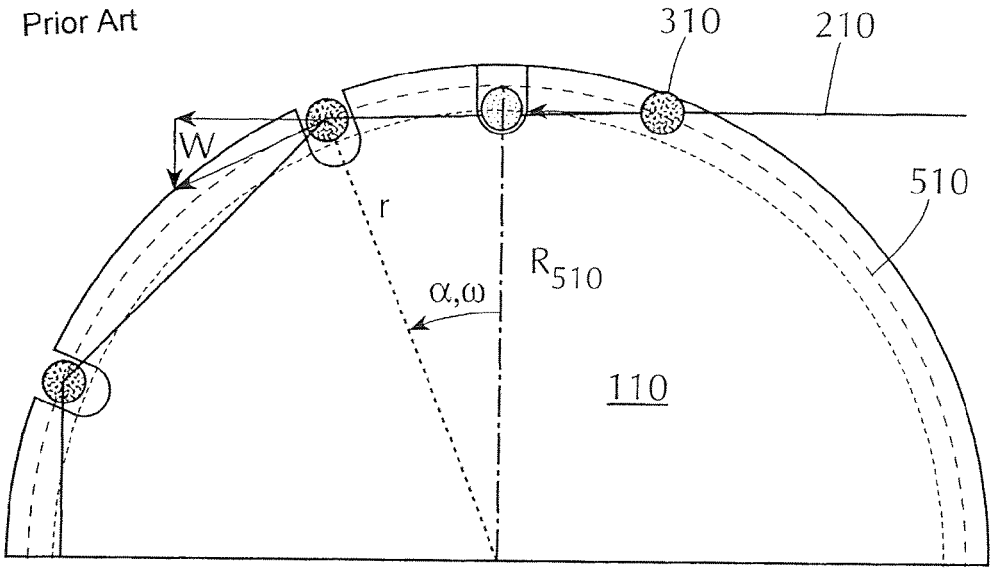
FIG. 2 is a diagrammatical representation of a chain wheel according to the state of the art in which the polygon effect is reduced by the chain pins sliding in the tooth spaces.
Figure 3:
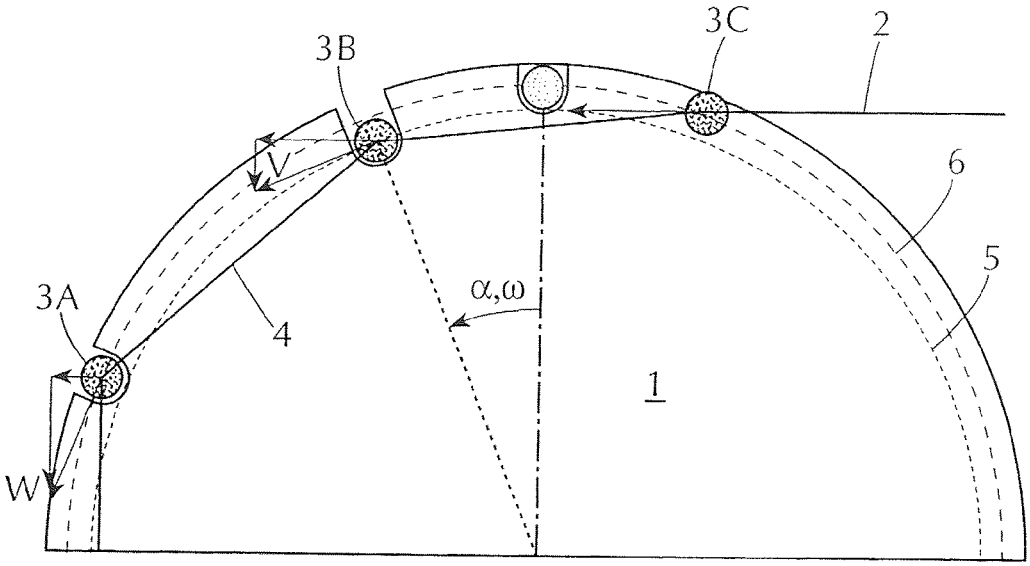
FIG. 3 is a simplified side view corresponding to FIGS. 1 and 2 of an engagement element according to an embodiment of the present invention.

As already explained in principle in relation to FIG. 3, the inner chain pins 3A, 3C are pulled into the chain wheel by the respective preceding outer chain pin 3B, 3D with constant longitudinal velocity on the first guiderail 9, since the preceding outer chain pins 3B, 3D are reversed on the outer pitch circle 6. Conversely, through being brought onto the outer pitch circle 6, the outer chain pins 3B, 3D are also accelerated in the vertical direction so that their total velocity along the guiderail(s) 6 remains constant although the longitudinal component of the inner chain pins 3A and 3C that pulls them reduces as the rotation of the chain wheel increases. The polygon effect is thereby prevented or greatly reduced.

FIGS. 5A and 5B illustrate the invention in which the driving and/or reversing element is embodied as a wedge wheel pair, the chain pins or rollers coming into positive contact with the wedge wheels. Each of the wedge wheels have alternately first areas with a first wedge angle and second areas with a different second wedge angle. First pitch circle 5 is defined by the contact points of the first chain pins with the first areas between the corresponding wedges of the wedge wheels while second pitch circle 6 is defined by the contact points of the second chain pins with the second areas between the corresponding wedges.

Figure 6:
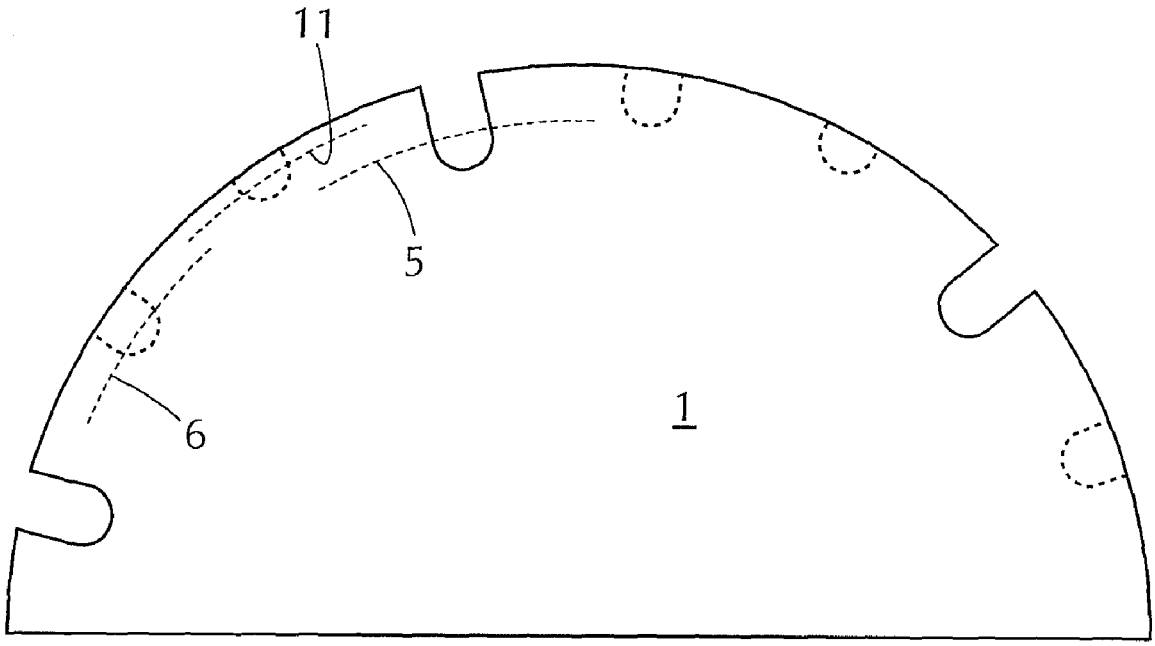
FIG. 6 is a diagrammatical side view of a chain wheel similar to that of FIG. 4 incorporating three pitch circles.

FIG. 6 depicts a construction in which engagement element 1 has three pitch circles 5, 6 and 11 employed in a similar manner to the construction of FIG. 4. The chain pins and rollers sequentially and alternately engage with one of the pitch circles. The engagement element may be of a stacked or multiple plate configuration to allow corresponding guiderails to be provided for each of the three pitch circles, while the chain pins and rollers are correspondingly divided.

We claim:

1. A chain driving and/or reversing system for an escalator, comprising a driving and/or reversing element and a chain having a plurality of chain plates or chain links joined together by chain pins located at ends of the chain plates or chain links, the driving and/or reversing element having first engagement surfaces on a first radius pitch circle for engaging a first group of the chain pins and second engagement surfaces on a second radius pitch circle for engaging a second group of the chain pins, the radius of the second radius pitch circle being different from the radius of the first radius pitch circle.

2. The driving and/or reversing system according to claim 1, wherein the chain pins have rotatably, slidably or swivelably borne chain roller or chain runner surfaces which engage the engagement surfaces.

3. The driving and/or reversing system according to claim 1 or 2, wherein the driving and/or reversing element is a chain wheel with toothing comprising the engagement surfaces.

4. The driving and/or reversing system according to claim 3, the toothing having alternately arranged first tooth spaces on the first pitch circle and second tooth spaces on the second pitch circle.

5. The driving and/or reversing system according to claim 1 or 2 wherein the driving and/or reversing element is a wedge wheel pair.

6. The driving and/or reversing system according to claim 5, wherein the wedge wheels have alternating first areas with a first wedge angle and second areas with a different second wedge angle, the first pitch circle being defined by contact points of the first group of chain pins with the first areas and the second pitch circle being defined by contact points of the second group of chain pin with the second areas.

7. The driving and/or reversing system according to claim 1 or 2 wherein the chain has at least one third chain pin and the driving and/or reversing element has third engagement surfaces on a third radius pitch circle for engagement with the at least one third chain pin.

8. The driving and/or reversing system according to claim 1 or 2 further comprising at least one guiderail to guide chain pins on at least one of the pitch circles.

9. The driving and/or reversing system according to claim 8, comprising first and second guiderail for respectively guiding the first and second chain pin groups through disengagement from the driving and/or reversing element.

10. The driving and/or reversing system according to claim 8 wherein the guided chain pins run or slide on the guiderail.

11. The driving and/or reversing system according to claim 1 or 2, wherein the chain runs tangentially onto at least one of the pitch circles.

12. The driving and/or reversing system according to one claim 1 or 2, wherein the chain run tangentially from at least one of the pitch circles.

13. A chain system for a continuous transportation system for the transportation of persons, comprising a chain with a plurality of first and second chain pins and chain plates joining the chain pins and a driving and/or reversing element according to claim 1 or 2.

* * * * *